US006874663B2

(12) United States Patent
Scheindel

(10) Patent No.: US 6,874,663 B2
(45) Date of Patent: Apr. 5, 2005

(54) DISPENSING ACTUATOR FOR PRESSURIZED CONTAINER

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 11 days.

(21) Appl. No.: 10/638,084

(22) Filed: Aug. 8, 2003

(65) Prior Publication Data

US 2005/0029312 A1 Feb. 10, 2005

(51) Int. Cl.[7] ..... B65D 83/00

(52) U.S. Cl. ..... 222/402.15; 222/402.21; 222/153.12

(58) Field of Search ..... 222/402.21, 402.22, 222/402.23, 402.25, 402.24, 402.1, 402.13, 402.15, 153.12, 182, 389

(56) References Cited

U.S. PATENT DOCUMENTS 2,914,224 A * 11/1959 Michel ..... 222/402.22
3,066,838 A * 12/1962 Hansen ..... 222/402.13
3,317,092 A * 5/1967 Jurasek ..... 222/402.13
3,648,905 A * 3/1972 Kauder ..... 222/402.21
3,661,300 A * 5/1972 Nigro ..... 222/80
3,759,431 A * 9/1973 Vos ..... 222/402.21
3,967,763 A * 7/1976 Focht ..... 222/402.15
4,428,509 A * 1/1984 Emerson et al. ..... 222/153.02
4,550,865 A * 11/1985 Hirao et al. ..... 222/402.21
5,641,095 A * 6/1997 de Laforcade ..... 222/182
5,702,036 A * 12/1997 Ferrara, Jr. ..... 222/402.13
5,915,599 A * 6/1999 Takahashi ..... 222/402.13
6,325,256 B1 * 12/2001 Liljeqvist et al. ..... 222/402.15
6,425,503 B1 * 7/2002 Scheindel ..... 222/402.22
6,494,349 B1 * 12/2002 Thompson et al. .... 222/402.15

* cited by examiner

*Primary Examiner*—Frederick Nicolas
(74) *Attorney, Agent, or Firm*—Reed Smith LLP

(57) ABSTRACT

A plastic dispensing actuator for a pressurized container used to dispense product has a dispensing nozzle that is mounted on the tilt valve of the container and a lever attached to the dispensing nozzle. The lever is attached by a living hinge to the wall of the nozzle. The lever is in the normal vertically aligned state for storage and shipment. It is rotated about the hinge to a horizontal dispensing state whereby actuation of the lever by depressing it causes the nozzle and the valve to tilt thereby dispensing product.

2 Claims, 2 Drawing Sheets

DISPENSING ACTUATOR FOR PRESSURIZED CONTAINER

BACKGROUND OF THE INVENTION

This invention relates in general to an actuator for actuating the dispensing valve in a pressurized container and more particularly to a manual actuating lever for use with a tilt valve and dispensing nozzle.

Tilt valves for pressurized containers are used to dispense a variety of products such as shaving cream, cheese products and wiped cream. Valve assemblies of such containers are describe in U.S. Pat. No. 4,805,813; U.S. Pat. No. 2,965,270; U.S. Pat. No. 2,957,610; U.S. Pat. No. 2,914,224 and U.S. Pat. No. 2,808,806.

U.S. Pat. No. 6,340,103 issued on Jan. 22, 2002 describes a hand operated lever arrangement for moving a valve and associated nozzle in a vertical or axial direction to dispense pressurized product from the container.

U.S. Pat. No. 5,785,301 issued Jul. 28, 1998 describes a tilt action valve assembly in which the seal between the valve and the container includes a thin wall boot portion that bows to accommodate stem movement. As certain of these known tilt action valve arrangements, the operator presses the nozzle which fits over the valve in a direction perpendicular to the axis of the nozzle to cause an arcuate movement that causes the tilting of the bottom portion of the valve into the container thereby exposing one or more valve openings to the pressurized product so that the pressurized product is forced through the valve stem to be used by the operator.

For many products, particularly those that are packaged under high pressure and are highly viscous, there is appreciable resistance of this tiling action. It can be either tiring or difficult to maintain at a predetermined tilt level so as to control the rate at which product is dispensed.

It is known to provide levers or mechanisms which are applied to the nozzle to provide a mechanical advantage in tilting the nozzle on the valve stem on which the nozzle is mounted.

However, such handles or levers can readily be displaced and hard to locate or provide a bulky addition to the can.

If mounted with the container when the container is sold, they have to be kept from accidentally actuating the nozzle and valve. This typically causes the need for substantial additional packaging.

Accordingly, it is a major purpose of this invention to provide a manually operated lever as part of the actuator of the valve used in a pressurized container.

A related purpose of this invention is to provide this lever in a compact fashion that minimizes additional packaging bulk.

A further related purpose of this invention is to provide the above purposes with a lever design which will not accidentally or unintentionally cause valve actuation during packaging or shipping or storing of the product.

BRIEF DESCRIPTION

A dispensing actuator for a pressurized container has a plastic integral nozzle and lever connected by a living hinge. The nozzle fits over the stem of the tilt valve that is associated with a pressurized container and the lever is connected to the nozzle by a living hinge. When the nozzle is placed over the stem of the tilt valve, the lever is in a normally vertical position and a cap can be fit readily over the lever and nozzle for shipment and storage. When product is to be dispensed, the cap is removed and the lever is rotated about its living hinge into essentially a horizontal position in which the base of the lever abuts against the sidewall of the nozzle. In that position, a downward force from the lever causes the nozzle and associated valve stem to tilt thereby dispensing product.

BRIEF DESCRIPTION OF THE FIGURES

FIG. 1 shows the cap 24 in exploded view.

DESCRIPTION OF THE PREFERRED EMBODIMENTS

Figure 1:
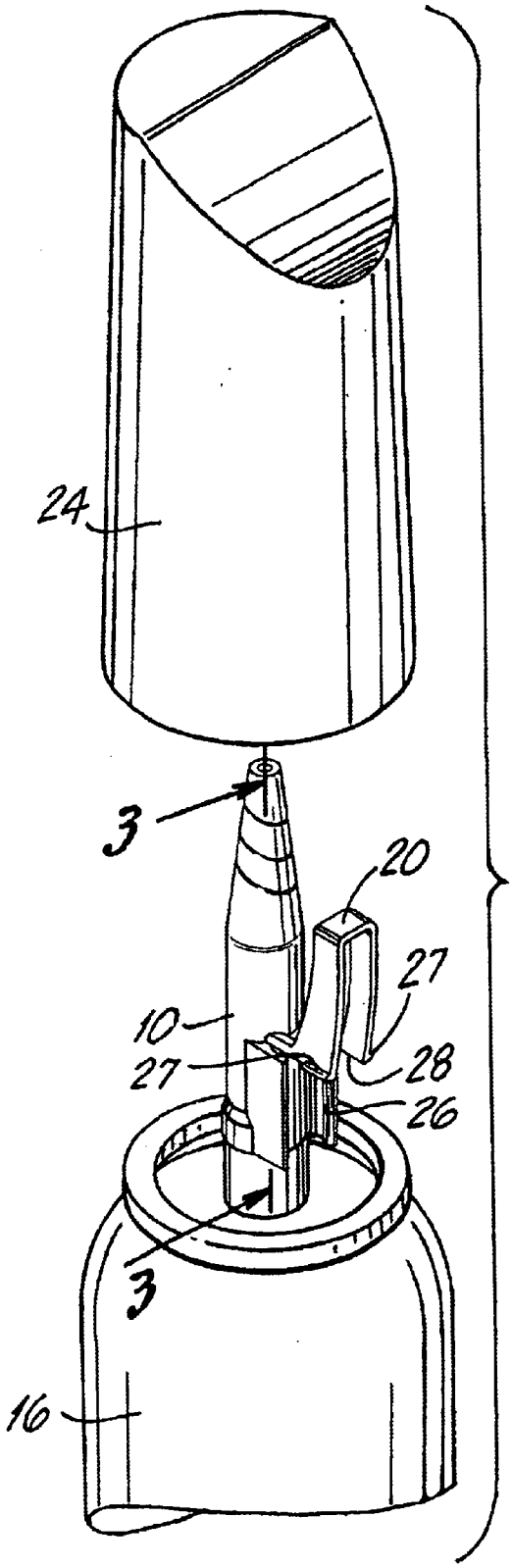
FIG. 1 is a perspective view, partially exploded, showing the nozzle 10 and lever 20 in a non-dispensing state; that is the state in which it is shipped.

All of the FIGs. relate to a single embodiment in which a nozzle 10 is mounted on the stem 12 of a valve. The valve in turn is in communication with the interior of the pressurized container 16 from which product is to be dispensed.

There are designs in which the valve is tilted in order to put it into its dispensing state and others where the valve is axially depressed in order put it into its dispensing state. The design of this invention is directed to the tilt valve situation.

In particular, the nozzle 10 is tilted and that causes the stem 12 of the valve to tilt which places openings (not shown) in the bottom of the stem into communication with the pressurized product. The product is then dispensed through these valve openings and through the central valve stem opening into the nozzle 10 and out the end 18 of the nozzle 10. Such operation is shown in U.S. Pat. No. 5,785,301.

What this invention contemplates is the use of a plastic hand operated lever 20 integral with the nozzle to cause the nozzle 10 to tilt and thus cause the valve to tilt and dispense product. The lever 20 and nozzle 10 are molded in the FIG. 1 state so that a cap 24 can be placed over lever and nozzle for shipping and storage.

Figure 5:
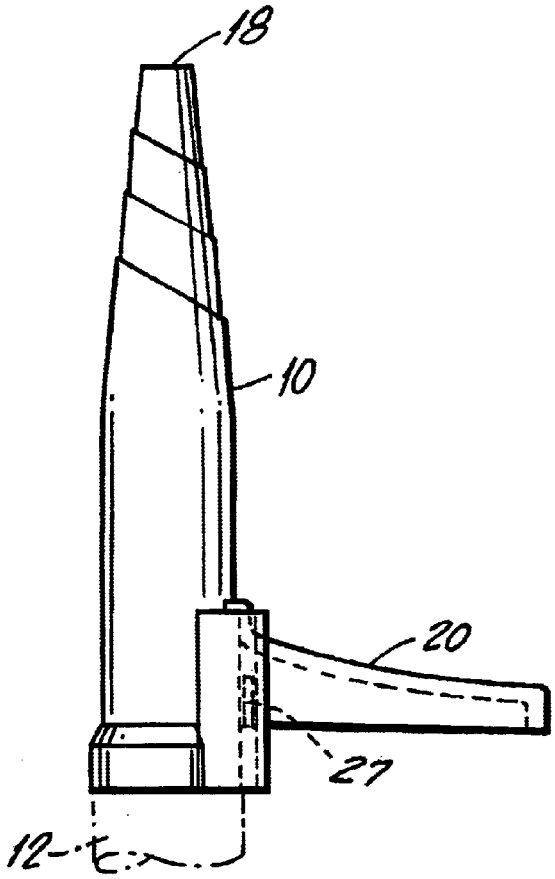
FIG. 5 is an elevational view showing the lever in its dispensing state.
Figure 4:
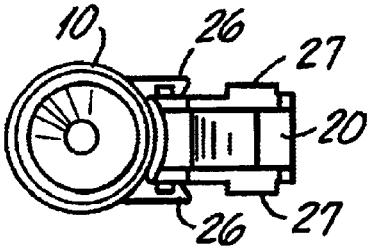
FIG. 4 is a bottom view of the nozzle and lever in the non-dispensing state.
Figure 6:
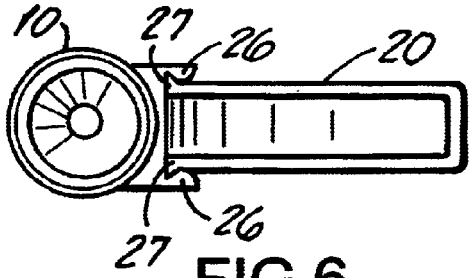
FIG. 6 is a bottom view of the nozzle showing the lever held in its dispensing state by an engagement between the lever edges and nozzle ribs 26.

The lever 20 is formed integrally with the nozzle 10 through what is called a living hinge 22. The nozzle 10 and lever 20 are formed of a polypropylene plastic material. The lever 20 can rotate about the hinge 22 between the dispensing state shown in FIGS. 2 and 5 and the non-dispensing state shown in FIGS. 1 and 3.

The nozzle 10 and lever 20 are preferably molded in the state shown in FIG. 1 with the lever 20 extending in a direction parallel to the axis of the nozzle. When rotated about the living hinge 22, the lever 20 becomes biased to return to its FIG. 1 non-dispensing state. Accordingly, it is advantageous to provide a holding mechanism to hold the lever 20 in the dispensing state. This is done by having an engagement between vertical ribs 26 outboard from the main wall of the nozzle 10 and ribs 27 on the two inboard edges 28 of the lever 20. This engagement can be either frictional or, because the material is plastic, can be a snap fit as shown in the FIGs.

Figure 2:
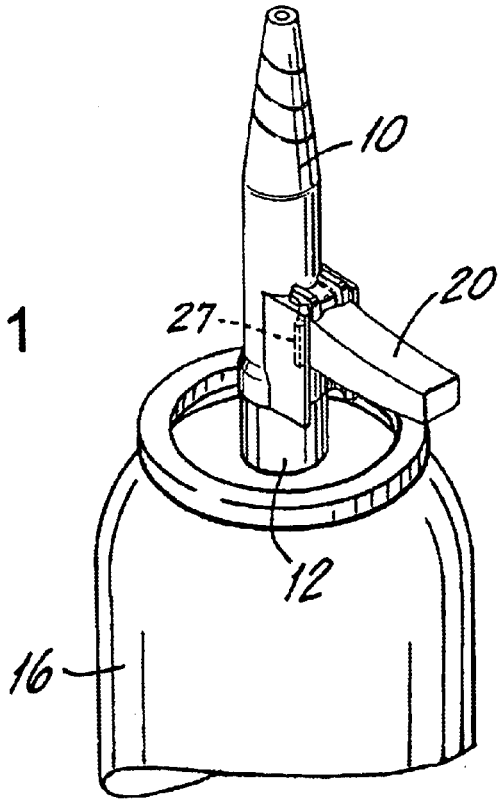
FIG. 2 is a perspective view similar to that of FIG. 1 showing the lever in its dispensing state.
Figure 3:
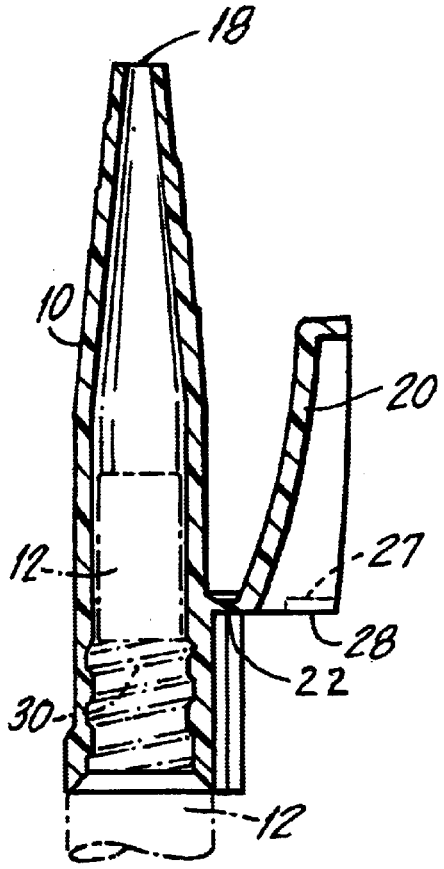
FIG. 3 is a longitudinal sectional view along the plane 3—3 of FIG. 1, of the nozzle and lever mounted on the valve stem where the lever is in the non-dispensing state.

When in the FIG. 2 dispensing state, the inner edges 28 of the lever 20 abut against the outer wall of the nozzle 10. When the lever 20 is pushed downwardly by the user, the lever 20 causes the nozzle 10 to tilt thereby carrying the valve stem within the nozzle into a tilting and thus dispensing state.

The nozzle 10 is preferably coupled to the stem 12 by means of a screw thread 30 arrangement.

If the product is not dispensed in a single dispensing session, the user will normally find it convenient and safe to move the lever 20 about the hinge 22 into its FIG. 1 non-dispensing state. This will avoid accidental dispensing of product and permits, if desired, placing the cap 24 over the nozzle 10 and lever 20 during storage between uses.

One advantage of the plastic living hinge 22 is that the nozzle and lever can be made and assembled at a minimum cost.

While the foregoing description and drawings represent the presently preferred embodiments of the invention, it should be understood that those skilled in the art will be able to make changes and modifications to those embodiments without departing from the teachings of the invention and the scope of the claims.

What is claimed is:

1. A dispensing actuator for a pressurized container having a tilt valve comprising:

a dispensing nozzle having a wall and adapted to be fitted over and engage the tilt valve, a lever coupled by a living hinge to the wall of said nozzle, said lever being movable between a non-dispensing storage and shipment state and a dispensing state, said lever having first and second engaging edges, said living hinge having a normal unbiased state which holds said lever in a vertical position that is substantially parallel to the axis of said nozzle, said vertical position providing said non-dispensing state, said living hinge having a biased position that urges said lever into said normal state, said lever in said biased position having a substantially horizontal position extending essentially perpendicular to the axis of said nozzle, said horizontal position providing said dispensing state, an engagement mechanism between said first and second engaging edges of said lever and said wall of said nozzle to hold said lever in said horizontal position, said engagement mechanism comprising a first spaced apart pair of vertical ribs on said nozzle and a second spaced apart pair of ribs on said edges of said lever, a first one of said ribs on said nozzle engaging a first one of said ribs on said lever and a second one of said ribs on said nozzle engaging the second one of said ribs on said lever when said lever is in said horizontal position, downward movement of said lever in said dispensing state causing said nozzle to tilt thereby causing the valve to dispense product contained in the pressurized container.

2. The dispensing actuator of claim 1 wherein:

said first rib on each of said edges of said lever latches to a corresponding one of said second ribs on said nozzle over a portion of said second rib, each of said ribs on the edges of said lever latching to a corresponding one of each of said ribs on said nozzle over only a portion of said ribs on said nozzle, each of said ribs on said edges of said lever extending over a portion of the respective one of said lever edges, said portion being the lower portion of said lever edges when said lever is in said horizontal position.

* * * * *